US005410399A

United States Patent [19]

Johnson

[11] Patent Number: 5,410,399

[45] Date of Patent: Apr. 25, 1995

[54] INTERPOLATIVE DIRECTION DETERMINING SYSTEM

[75] Inventor: Philip M. Johnson, Windham, N.H.

[73] Assignee: Lockheed Sanders, Inc., Nashua, N.H.

[21] Appl. No.: 626,461

[22] Filed: May 30, 1994

Related U.S. Application Data

[63] Continuation of Ser. No. 278,802, Jun. 29, 1981, abandoned.

[51] Int. Cl.[6] ..... G01B 11/26; F41G 7/00; B64D 47/06

[52] U.S. Cl. ..... 356/152.1; 244/3.13; 340/982

[58] Field of Search ..... 455/608; 356/152; 244/3.13, 3.16; 340/26, 982; 359/155, 181

[56] References Cited

U.S. PATENT DOCUMENTS 3,662,180 5/1972 Jorgensen et al. .
3,704,070 11/1972 Johnson et al. .
3,799,675 3/1974 Johnson et al. .
3,882,482 5/1975 Green et al. .
4,100,404 7/1978 Johnson et al. .

*Primary Examiner*—Stephen C. Boczinski
*Attorney, Agent, or Firm*—David W. Gomes

[57] ABSTRACT

Apparatus for determining position within a beam, comprising pulses of energy transmitted in coded patterns, is achieved by processing the signals received from the beam to generate a value indicative of coarse position within the beam and by interpolation within the coarse position to generate a value resolving fine position within the coarse position.

11 Claims, 12 Drawing Sheets

INTERPOLATIVE DIRECTION DETERMINING SYSTEM

This application is a continuation of application Ser. No. 278,802, filed Jun. 29, 1981, now abandoned.

BACKGROUND OF THE INVENTION

U.S. Pat. Nos. 3,662,180; 3,704,070 and 3,799,675 disclose techniques for encoding a sector of space by transmitting pulses of energy in coded, optical grating patterns so that a receiver located within the sector can determine its position relative to a reference direction through the transmitter by noting the sequence of received pulses. The patterns transmitted are arranged in a binary code such as the Gray code and comprise light and dark (illuminated and non-illuminated) areas.

One application of such space encoding is for an optically guided missile and is set forth in U.S. Pat. No. 4,100,404. This patent discloses a projector which emits a spacially encoded guidance beam along a line of sight between a missile gunner and a target. A missile in flight would carry sensors responsive to the guidance beam and would detect the angular deviation of the missile from the line of sight between the gunner and target. Corrections could then be made to the flight path of the missile in accordance with the angular deviation.

The spatially coded guidance beam of U.S. Pat. No. 4,100,404 is produced by a laser-illuminated slide projector in which there are a plurality of coded reticles or "slides" mounted on a spinning code disc. The spinning disc has position references so that a laser is pulsed each time a reticle pattern is properly located on the projection lens optical axis. A sequence of different patterns is projected into the same space for each revolution of the code disc. The receiver on the missile would receive a sequence of laser flashes that is different for each of a number of positions in space.

In such systems azimuth and elevation can be each separately encoded with its own set of patterns. A clear reference pattern is projected prior to groups of Gray code "data" patterns comprising clear and opaque segments. The receiver would store the amplitude of the reference pulse and then compare the received values of the data pulses with it. If a data pulse is greater than 50% of the reference in amplitude, it is designated a "one". If it is less, it is designated a "zero". This procedure, repeated for each data pulse, accurately determines whether the center of the receiver aperture is in the shaded or clear areas of the transmitted patterns.

In the projector of U.S. Pat. No. 4,100,404, the preferred illuminators are laser diodes. Laser diodes are typically GaAs and emit incoherent radiation at 0.9 micrometers. While the performance of this projector was satisfactory, it did exhibit some problems when subjected to possible battlefield conditions, namely, attentuation of the signal through smoke.

Experimentation has shown that much less attenuation due to smoke, haze and fog occurs if longer wavelength radiation sources are used. Because of extensive laser development of $CO_2$ lasers interest has centered on the 10 micrometers region.

At 0.9 micrometers the quantization increments of the grating patterns (the width of the light and dark areas) can be made sufficiently small to give a satisfactory degree of positional accuracy to a receiver. At 10.6 micrometers, for example, it is not practical to use quantization increments as small as those which can be used for 0.9 micrometers due to optical diffraction. The degree of optical diffraction is determined by the relationship $\lambda/D$ where $\lambda$ is the wavelength of the source radiation and D is the diameter of the projection lens. Thus, as the wavelength increases, the diameter of the projection lens must be increased proportionally to minimize optical diffraction. Increasing source wavelength from 0.9 micrometers to 10.6 micrometers requires a substantial increase in projection lens diameter which is much too large for practical applications.

Accordingly, it is an object of this invention to provide an improved direction determining system.

SUMMARY OF THE INVENTION

A laser beamrider direction determining system comprises a projector for projecting into space an encoded beam. The projected beam includes pulsed reticle patterns having multiple knife-edges (lines of demarcation between light and dark areas) with adjacent reticle patterns comprising a complementary pair. A clear reference pattern is projected prior to a group of complementary pairs. Fewer clear reference patterns (i.e., more complementary pairs between reference patterns) may be used when the pulse repetition frequency is high enough so that there is a high temporal correlation in the atmospheric turbulence between reference pulses.

A receiver in space locates its position relative to the projector by processing the information received from the encoded beam. By measuring the pulses received from distinct reticle patterns the receiver generates a Gray code number. The most significant bit of the Gray code number determines the relative position of the receiver with respect to the boresight of the projector. For example, for projected reticle patterns to determine position in the X direction, the most significant bit of the Gray code number determines whether the receiver is left or right of boresight. The remaining bits of the Gray code are converted to binary to designate a predetermined area (or bin) within which the receiver lies, i.e., coarse positional information.

Lastly, measurements are made of the signal received from the projected reference patterns and complementary reticle patterns to permit the receiver to generate a signal to interpolate where in the particular bin the receiver lies and, thus, to provide fine positional information.

BRIEF DESCRIPTION OF THE DRAWINGS

The above-mentioned and other features and objects of this invention will become more apparent by reference to the following description taken in conjunction with the accompanying drawings, in which.

DESCRIPTION OF PREFERRED EMBODIMENTS

Figure 1:
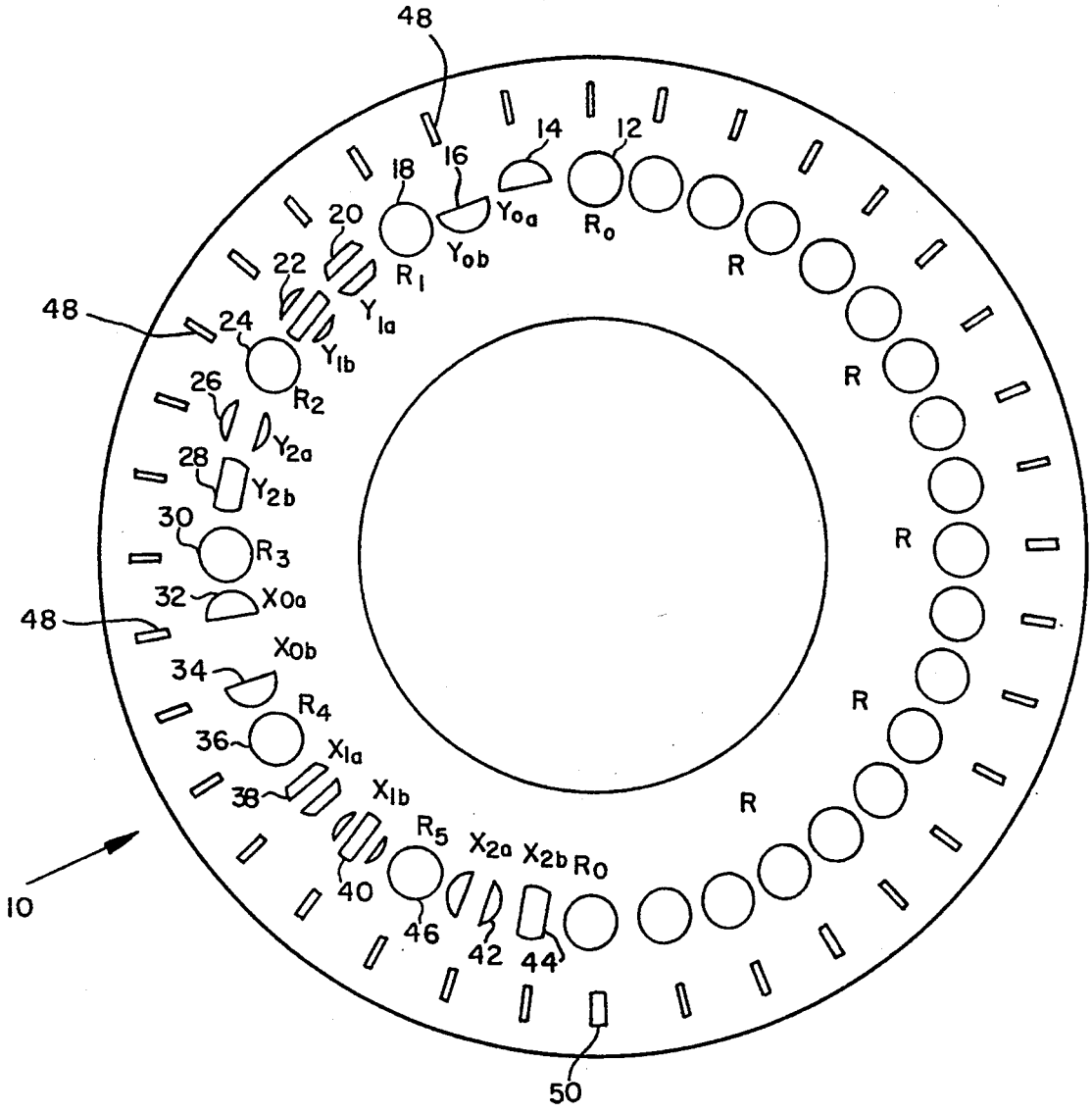
FIG. 1 is a plan view of a typical code disc for generating reticle patterns used in the direction determining system projector.

The invention described herein pertains to a receiver for processing signals from a projector which transmits reticle patterns so as to allow the receiver to determine its position with respect to a reference direction. In the preferred embodiment the projector includes a rotating code disc 10 as shown in FIG. 1 of the drawings. The disc is rotated in front of a pulsed laser such as a 10.6 micrometer $CO_2$ pulsed laser. However, other isotopic forms of $CO_2$ and other laser lines may be used to provide different laser wavelengths in the 10 micron region. During each rotation of disc 10 one data word is transmitted which consists of the transmission through 18 reticles 12–46.

Figure 2:
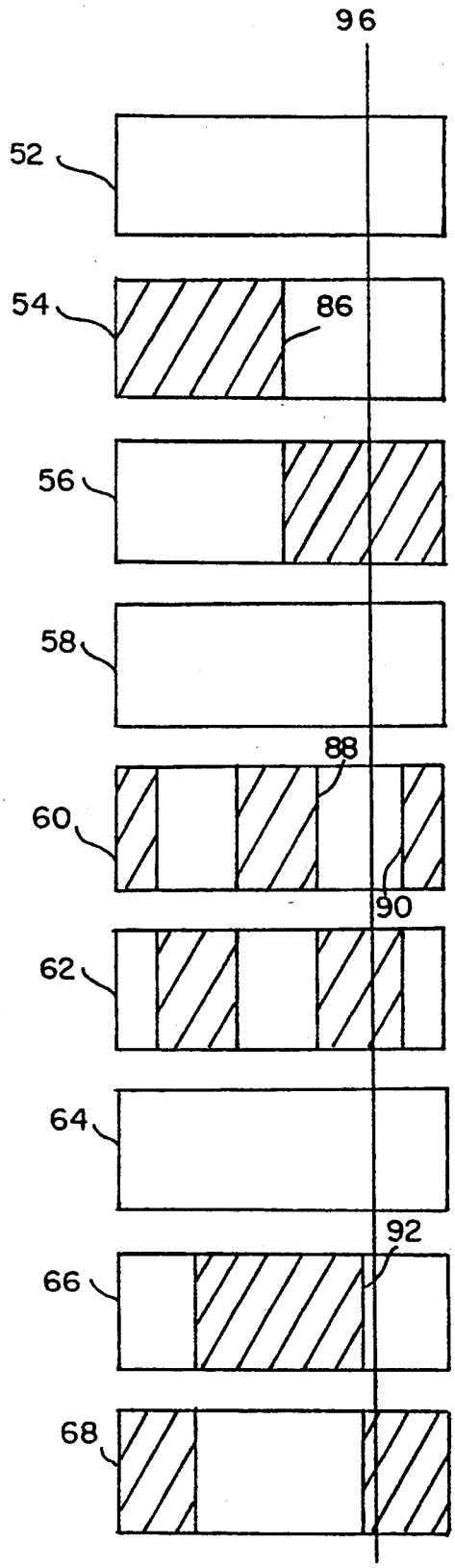
FIG. 2 is a diagram illustrating a typical code sequence used in the code disc of FIG. 1.

The data word is of the general code sequence illustrated in FIG. 2. Starting at the top of FIG. 1 and proceeding counterclockwise, there are three pairs of elevation patterns, 14, 16; 20, 22; 26, 28; followed by three pairs of azimuth patterns, 32, 34; 38, 40; 42, 44. Each pair is preceded by a clear reference pattern, 12 or 18 or 24 or 30 or 36 or 46, which is preferably simply a hole in the disc 10. The right hand portion of the code disc is for a bias command function useful in the beam projector for, for example, commanding the missile to fly to some beam coordinates other than boresight or to provide rate bias. Timing references 48, disposed about the periphery of disc 10, are small slits located accurately with respect to each reticle pattern. The laser is triggered on the leading edge of each slit (clockwise disc rotation) and a disc speed control feedback signal is generated from the trailing edges. As seen in the drawing, one timing slit 50 at the start of the eighteen-pattern bias reticle sequence, is larger than the others. Slit 50 is diametrically opposite to its corresponding pattern 12 because it was found convenient to locate the timing pickoff source and detector on the opposite side of the disc from the laser beam path. This slit is larger because the first reticle in the set is positioned for projection ten percent earlier than the other patterns, providing the receiver with a synchronizing signal. Thus, the leading edge of the wide timing slit is in the proper position to trigger the laser early, while the trailing edge is still in its proper position to generate a constant pulse repetition frequency (PRF) speed control reference.

The code sequence of FIG. 2 includes a completely transparent pattern 52 followed by complementary pairs 54, 56, a second reference pattern 58 followed by complementary pairs 60, 62 and a third reference pattern 64 followed by complementary pairs 66, 68.

At relatively short wavelengths (e.g. 0.9 micrometers) additional patterns containing thinner bar widths (smaller quantization elements) could be projected in order to give better resolution to a receiver as to where in the projected pattern it is located. However, in the 10 micron range, the preferred wavelength region, optical diffraction becomes a limiting factor as to how narrow the bars of the grating patterns can be made, and, therefore, also as to how narrow the quantization increment can be.

In the shorter wavelength systems the reference patterns were used to establish a reference level, and using the data patterns a receiver determined if it was in a light or clear area of the pattern if the signal received was greater than fifty percent of the reference signal (signifying a logical "1") and in a dark or opaque area if the signal received was less than fifty percent of the reference signal (signifying a logical "0").

Since at 10 micrometers only relatively wide bars (each 2 quantization elements wide) of the grating patterns can be employed, good resolution or accurate position information cannot be obtained only by using the fifty percent determination. Accordingly, to obtain better resolution, it is necessary to measure intensity level in finer signal level increments than 1 or 0, and to therefore interpolate receiver position to some fraction of a quantization increment. The nature of projected diffraction limited images provides a means to do this.

Figure 3:
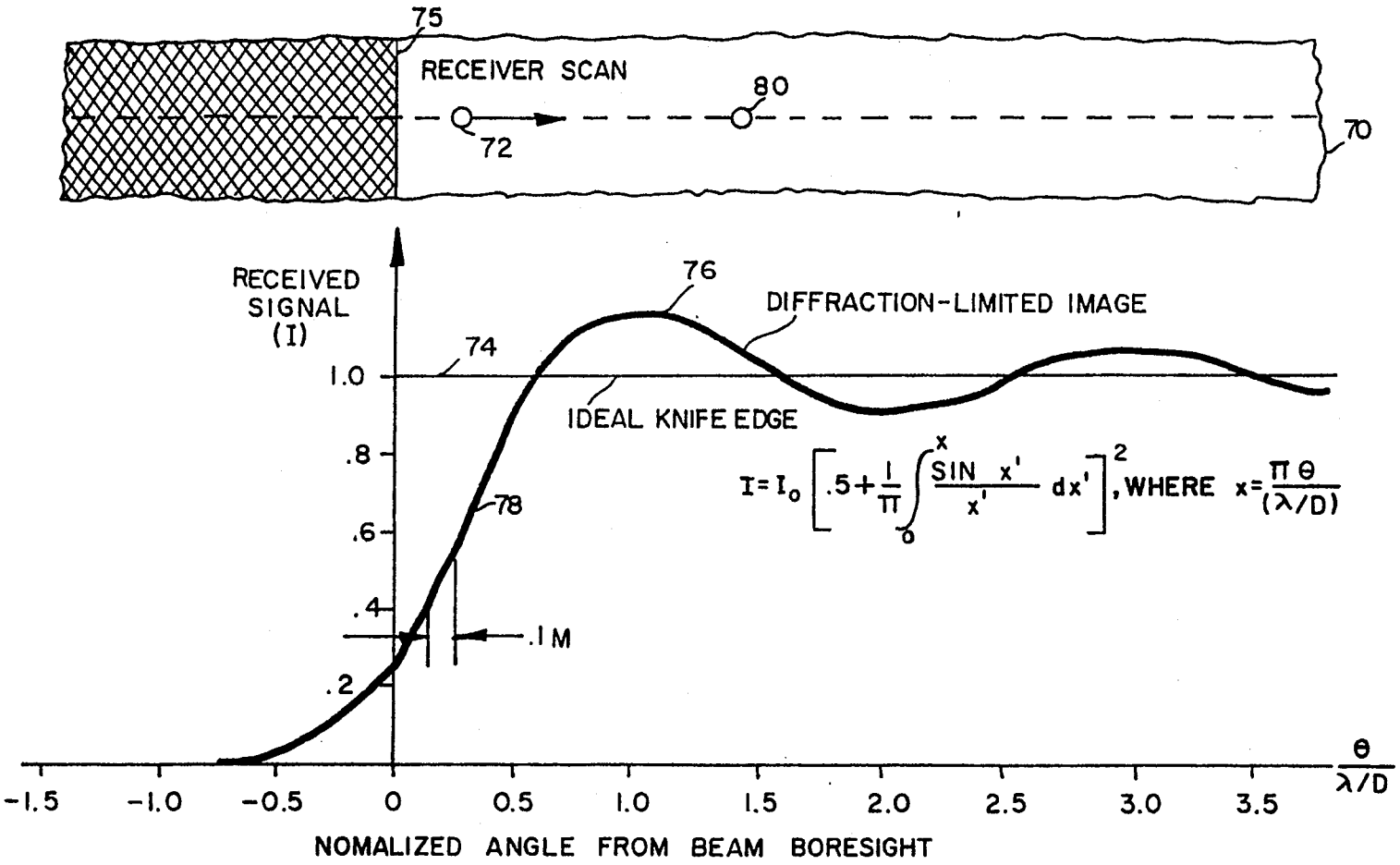
FIG. 3 is a diagram of a projected knife-edge and the signal which would be received by a receiver scanning the projected pattern (transfer function)

FIG. 3 illustrates a portion of a grating pattern 70 (like pattern 54 of FIG. 2) and where 72 in the projected pattern a receiver is located. Below the pattern 70 there is illustrated a plot of the signal intensity obtained when a receiver scans across the projected image (transfer function). The transition at the knife edge 75 (where the light and dark areas of the projected pattern meet) does not produce a sharp defined transition like the curve 74, but instead the curve 76, the difference being caused by optical diffraction. However, in the linear portion 78 of the curve 76 it is seen that the receiver signal will change by a measurable amount, approximately 10% of maximum signal, for a change in receiver position of 0.1 meter (where $\lambda=10.6\mu$ and $D=2.5$ inches). The shape of the diffraction pattern intensity curve 76 is a function only of beam projector aperture and wavelength, thus, it is repeatable. The basic mechanism, therefore, exists for precise receiver interpolation of its position within a quantization increment by taking advantage of the diffraction-limited image.

There are, however, certain problems with this solution. One problem is that interpolation only can be made within the gradient transition area, that portion 78 of the curve 76 which is substantially linear. If the receiver is in position 80, for example, fine resolution cannot be obtained. A second problem exists in that unknown signal strength will shift the curve scale. For example, the ideal knife edge signal point may be 2.0 units of amplitude instead of 1.0 due to a strong laser pulse illuminating the projected pattern. A third problem exists in that the curve is not a convenient curve from which to determine position since at boresight the error signal is not zero, but rather greater than 0.2. Thus, the points of curve 76 must be stored to provide indication of error versus signal strength.

The hereinafter described embodiments of this invention remedy all of these problems.

The remedy for the second problem (unknown signal strength of the illuminating laser) is achieved by the transmission of the clear reference before each data pattern. In FIG. 2 these are the clear reference patterns 52, 58 and 64 and in FIG. 1 the reference patterns 12, 18, 24, 30, 36 and 46.

The third problem is remedied by transmitting complementary data patterns. That is, in FIG. 2 instead of merely transmitting pattern 54, the complement of this pattern is also transmitted; namely, pattern 56.

Figure 4:
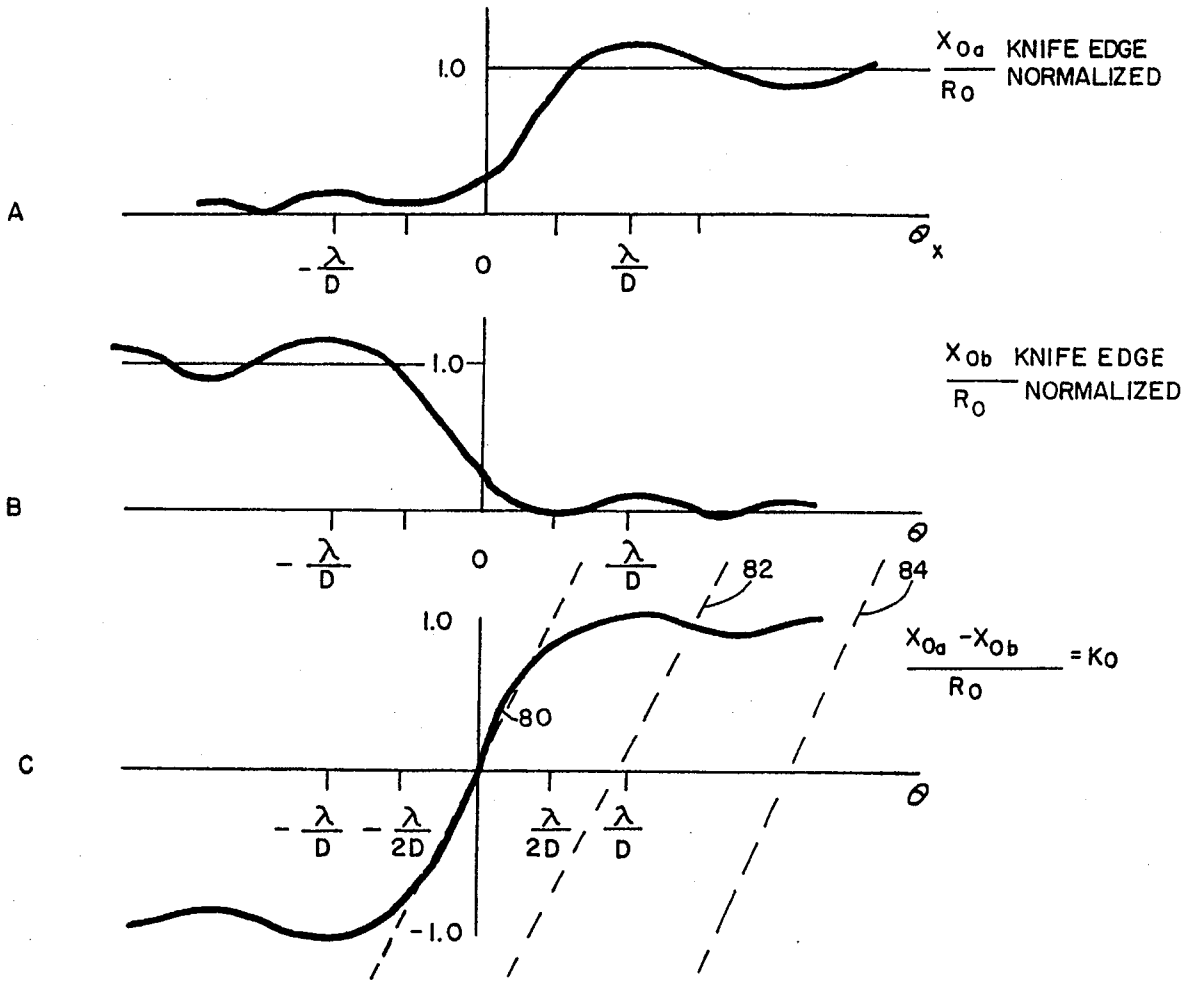
FIG. 4 are diagrams of normalized transfer functions from complementary reticle patterns and a diagram of the differential transfer function of the complementary patterns.

The result of this is illustrated in FIG. 4. If curve A of FIG. 4 is the normalized transfer function of the projected pattern 54 and curve B the normalized transfer function of the projected pattern from the complement of pattern 54, pattern 56, then taking the difference between A and B provides curve C which as illustrated does provide zero error at the origin.

Neither of the two aforementioned techniques are new in themselves and remedying these two problems does not remedy problem one, since as seen by curve C of FIG. 4, the created linear transfer function 80 extends only over a narrow width near the origin or boresight. For a 10.6 micrometer laser with a 2.5 inch projection lens the linear transfer function extends over a width of substantially less than $\lambda/D$ or substantially less than 0.83 meters at a distance of 5000 meters. For many applications this is unacceptable.

In order to obtain positional information over a wider area, the patterns 54, 56 (the only distinct patterns projected in one embodiment) can be shifted in time by firing the laser at different times. By delaying the firing of the laser the curve 80 will be shifted. Each delayed firing will provide an additional knife-edge, like slope 80 of FIG. 4, but displaced therefrom. If two additional delayed firings are used to illuminate space with patterns 54, 56 but shifted in time; two additional knife-edge slopes 82, 84 will be generated. By generating N knife-edge slopes the entire radiated beam can be covered and a receiver by taking a reading on the knife-edge slopes can accurately determine its position. This method while adequate however requires N triplets for N quantization increments. That is, reticles 52, 54, 56 (albeit shifted in phase) must be projected for each knife-edge slope.

Rather than employing shifted knife-edges, $\lambda/D$ could be made large enough by use of smaller projection lens diameter to cover the entire beam within a gradient. However, the accuracy of beam position measurement suffers in this case because of a lower slope in the gradient—a given error in pulse amplitude measurement creates a large angular error.

The receiver to provide positional information is described hereinafter with reference to the description of FIG. 7. The optimum solution to be described uses a Gray code arrangement in which N transition regions can be generated by n complementary pairs, where $N=2^n$. This solution permits obtaining the same accuracy using fewer patterns to encode space and, thus, requires a corresponding decrease in the amount of processing required and in the number of laser pulses required, leading to a significant reduction in required laser average power.

In this embodiment, instead of merely using only two distinct complementary patterns, a plurality of patterns corresponding to a binary Gray code is used. In FIG. 2, instead of only using the data patterns 54, 56 as in the previously described embodiment, the data patterns 60, 62 and 66, 68 are also employed. The use of patterns conforming to a binary Gray code reduce the total number of pulses required to encode a predetermined sector of space. This is because such a code provides multiple edges in a single illumination pattern and, thus, results in a reduction of the number of total patterns and, hence the number of pulses transmitted. This embodiment uses the digital Gray code principle previously mentioned in conjunction with analog vernier interpolation.

In order to explain this embodiment, certain functions are here in de fined:

R is defined as the intensity of the signal received from illumination of a sector of space by pulsing of one of the reference patterns (patterns 12, 18, 24, 30, 36, 46 of FIG. 1); thus, $R_0$ is from the pulsing of the first reference pattern 12, $R_1$ is from the pulsing of the second reference pattern 18, etc.

X is defined as the intensity of the signal received from illumination of a sector of space by pulsing one of the patterns which codes space in the X direction (patterns 32, 34, 38, 40, 42, 44 of FIG. 1). For a particular pattern, X varies as a function of receiver position within the pattern. The subscripts 0, 1, 2 refer to the particular doublets 32, 34; 38, 40 and 42, 44. The subscripts a and b refer to which pattern of a doublet. Thus, $X_{0b}$ refers to the second pattern 34 of the first doublet 32, 34 for coding space in the X direction.

Y is defined similar to X, however, for signals received from patterns for coding space in the Y direction. Note that the functions refer to both the intensity of signal at a receiver in the space to be encoded and the particular pattern used i to encode such space.

K is defined as the normalized difference from the patterns of a doublet; thus, $$K_0 = \frac{X_{0a} - X_{0b}}{R_0}.$$

A typical example is shown in FIG. 4 where curve C illustrates $K_0$.

Using the aforementioned functions, whose value is measured or calculated from the signals received from illumination of a sector by a beam having the reticle patterns imposed thereon, the position of a receiver in the beam can be readily determined. Determination of such position is made by first determining in which coarse Gray code bin (quantization increment) the receiver is located. In the illustration of FIG. 3, a determination is made if the receiver is to the right (light area) or to the left (dark area) of the edge 75. If in the light area, a further computation is made to determine where on the gradient transition region of the curve (the substantially straight line portion thereof) the receiver is precisely located.

In order to determine the above, one additional function need be defined and this is $G_n$. $G_n$ is equal to the Gray code value associated with the nth pair as a function of receiver position. G values are determined by thresholding the K values such that $G=0$ if K is equal to or less than zero and $G=1$ if K is greater than zero. This procedure is essentially the same as the fifty percent thresholding described earlier.

Figure 5:
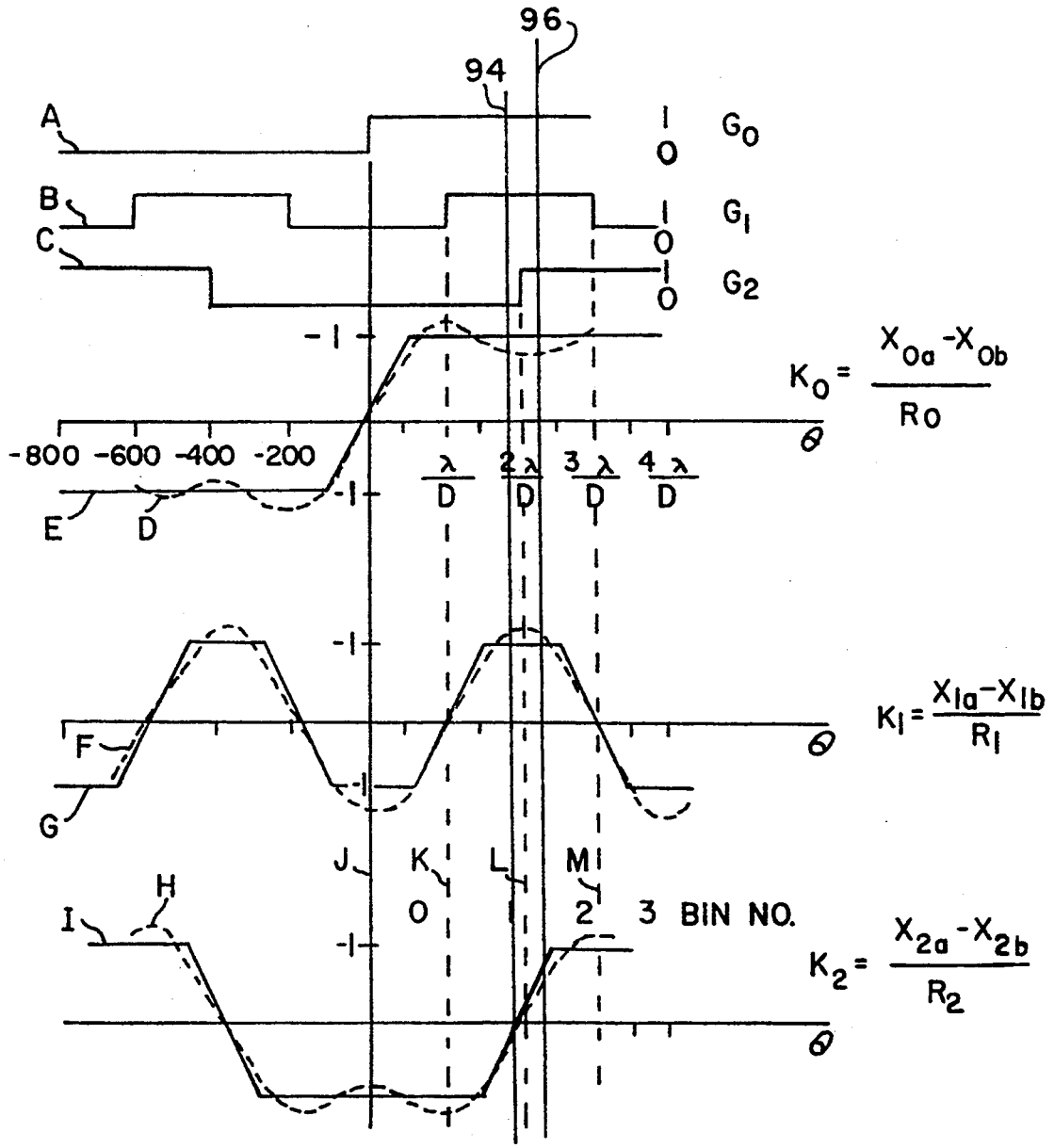
FIG. 5 are diagrams of waveforms illustrating the principles of the invention.

The manner in which position determination is accomplished is explained in conjunction with FIG. 5 of the drawings. Curves A, B and C represent idealized patterns in space which would be obtained from illuminating and projecting reticle patterns 54, 60 and 66 of FIG. 2. Curve D represents the actual $K_0$ intensity pattern and curve E represents the idealized $K_0$ intensity pattern. Likewise curves F, G, and H, I, represent the actual and idealized functions $K_1$ and $K_2$. The lines J, K, L and M represent the edges in the reticle patterns (see FIG. 2). Line J represents the edge 86, line K the edge 88, line L the edge 92, and line M the edge 90.

In order to determine receiver position, the bin in which the receiver is located must first be identified, in the FIG. 5 example, the bin between J, K or K, L or L, M, for example. This is determined by converting the Gray number to a binary number, then converting the binary number to decimal. The binary value may also be converted to an analog voltage. In the FIG. 5 illustration assume the receiver is at position 94. The Gray number hence would be 110 since the pulse through pattern 54 would produce a pulse at the receiver (the receiver being in the light area), $G_0=1$, the pulse through pattern 60 would produce a pulse at the receiver (the receiver being in the light area of this illuminating pattern), $G_1=1$ and the pulse through pattern 66 not producing a pulse at the receiver (the receiver being in a dark area of this illuminating pattern ), $G_2=0$.

The 1st digit, 1, of the Gray code number 110 is the sign number, if 1 equals plus (+) if zero equals minus (−). The sign designates on which side of boresight the receiver is located (in the example of FIG. 5 only positions on one side of boresight are discussed). Thus in the example the sign is since the first digit of 110 is a one. The next step is to convert the remainder of the Gray number to binary and then to decimal in standard fashion. In the example, 10 in Gray equals 01 binary equals 1 decimal and as can be seen in FIG. 5 the receiver at position 94 does in fact lie in bin 1.

The digital number and analog voltage representing the bin number gives course position information. (The analog voltage is generated in a digital-to-analog converter). In order to obtain more accurate positional information, voltage or, equivalently, several lessor significant bits of a binary number must be added to or subtracted from the value obtained from the earlier bin determination process.

Empirically, it has been determined that for a value of $G_2=0$, the position of the receiver (X) is determined from the algorithm:

for a value of $G_2=0$ $$Xout=2(\lambda/D)\,(G_0-0.5)\,|[1+0.5(|K_0|+K_1+K_2)]|$$

and for a value of $G_2=1$ $$Xout=2(\lambda/D)(G_0-0.5)\,|[1.75+0.5(|K_0|+K_2)-0.25K_1]|$$

These algorithms are, of course, for the case where three data patterns are projected (the case described in FIGS. 1, 2 and 5).

A general algorithm for all cases is the following:

$$X = 2(G_0 - 1/2)(\lambda/D)\left[1/2 + \sum_{n=1}^{N} B_n 2^{n-1} + 1/2 \sum_{n=0}^{N} A_n K_n\right]$$

wherein

X=decimal value of vertical or horizontal angular coordinate in beam, $G_0$=Gray code sign bit, $\lambda$=wavelength of radiation, D=diameter of transmitting aperture, N=number of Gray code reticle pairs projected per axis or number of bits in received code word, $B_n$=value of nth binary bit (after Gray code word is converted to natural binary), $K_n$=normalized difference in amplitude of nth Gray code pulse pair, and $A_n$=slope coefficient.

After conversion of the N bit Gray code number to natural binary, but using the definitions:

$B_0$=sign bit $B_{N-1}$=most significant bit $B_1$=least significant bit $B_N=0$, the slope coefficient $A_n$ can be obtained either from a look-up table or by the following algorithms, using Boolean algebra:

$$|A_0|=\overline{B_{N-1}+B_{N-2}+\ldots B_1}$$

$$|A_1|=1$$

$$A_2|=(B_2\oplus B_1),\text{ where }\oplus\text{ is exclusive OR operation}$$

$$|A_n|=(B_n\oplus B_{n-1}).(\overline{B_{n-1}\oplus B_{n=2}}).(\overline{B_{n-2}\oplus B_{n-3}}).\ldots.(\overline{B_2\oplus B_1})$$

The signs of the slope coefficients are obtained from the following rules:

1. Sign of $A_0$ is + always
2. Sign of $A_n$ is + when $B_{n+1}=0$

Figure 6:
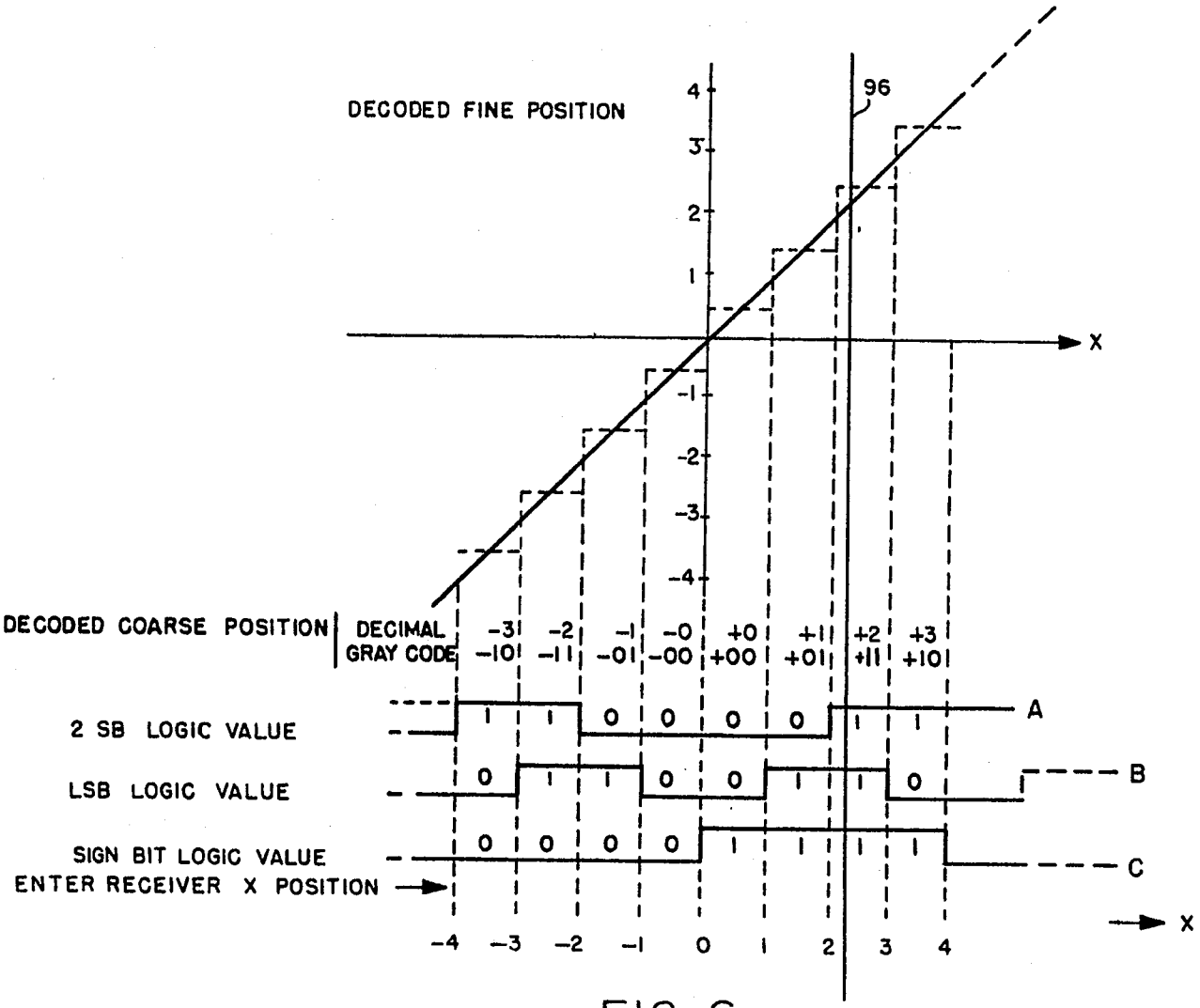
FIG. 6 are diagrams of a series of waveforms illustrating the principles of this invention.

One example of employing this algorithm is described in conjunction with the waveforms illustrated in FIG. 6 of the drawings. The line 96 represents the position of a receiver in the beam. The reticles generating the patterns in space and the position of the receiver 96 within the reticle patterns are illustrated in FIG. 2 of the drawings.

The Gray number in this example is 111; $G_0=1$, $G_1=1$, $G_2=1$. The expression $2(G_0-\frac{1}{2})$ of the algorithm becomes $2(1\frac{1}{2})=1$. This is the sign bit and indicates that the receiver is to the right of boresight which is clearly shown by position 96 of FIG. 2.

The second expression Of the algorithm inside the brackets, $$\sum_{n=1}^{N} B_n 2^{n-1},$$

indicates in which bin the receiver resides (in decimal). Converting the Gray number 111 into binary is +10 which equals 2 in decimal. If the $$1/2 + \sum_{n=1}^{N} B_n 2^{n-1}$$

is carried out with the binary number 10, the result will be $2\frac{1}{2}$. Thus this portion of the algorithm indicates that the receiver is in bin 2 which agrees with that shown in FIG. 6.

The reason the result is $2\frac{1}{2}$ and not 2 is that the additional $\frac{1}{2}$ biases the pattern so that the transfer function can be symmetrical about zero and with equal increments.

The next expression of the algorithm, $$1/2 \sum_{n=0}^{N} A_n K_n,$$

provides the vernier correction.

Referring to the procedure discussed, noting that N=3, we have already identified the natural binary word as +10, i.e., $B_N=0$ (by definition, since $B_{n-1}$ is most significant bit)

$B_{N-1}=B_2=1$ (most significant bit)

$B_{N-2}=B_1=0$ (least significant bit)

Now employing the procedure algorithms for determining the slope coefficient, we determine that:

$|A_0| = (\overline{1+0}) = 0$
$|A_1| = 1$
$|A_2| = (1 \oplus 0) = 1$
Sign of $A_1 = -$
Sign of $A_2 = +$
Then $$+1/2 \sum_{n=0}^{N} A_n K_n = 1/2(K_2 - K_1).$$

Now referring to FIG. 5 for receiver position 96, we find that $K_2 = 0.6$ and $K_1 = 1$ Therefore, $\frac{1}{2}(K_2 - K_1) = -0.2$ which is the correction term.

In summary, the expression $$1/2 + \sum_{n=1}^{N} B_n 2^{n-1} + 1/2 \sum_{n=0}^{N} A_n K_n$$

becomes $[\frac{1}{2} + 2 - 0.2] = 2.3$, which can be seen in FIG. 6 as the proper value for receiver position 96.

Figure 7:
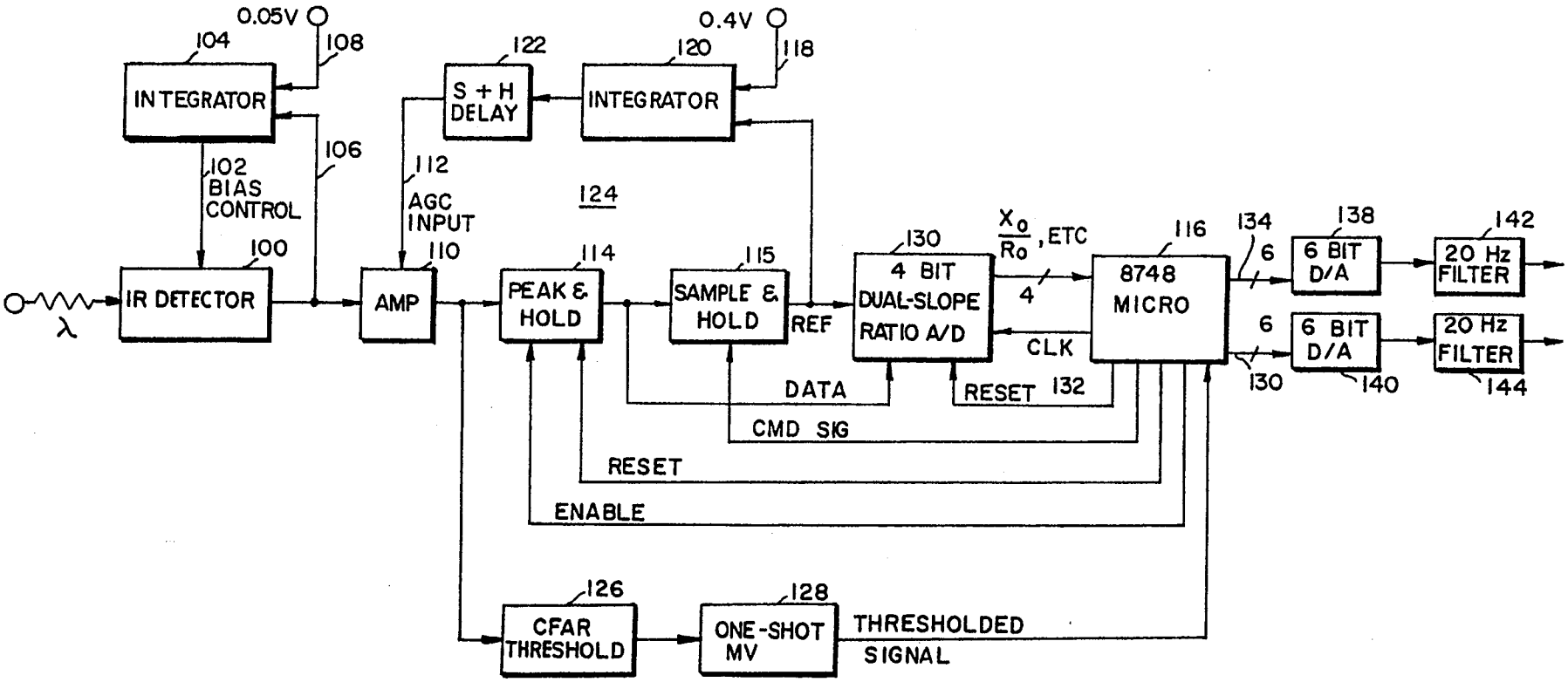
FIG. 7 is a block diagram of a receiver for determining direction from a projector.
Figure 8A:
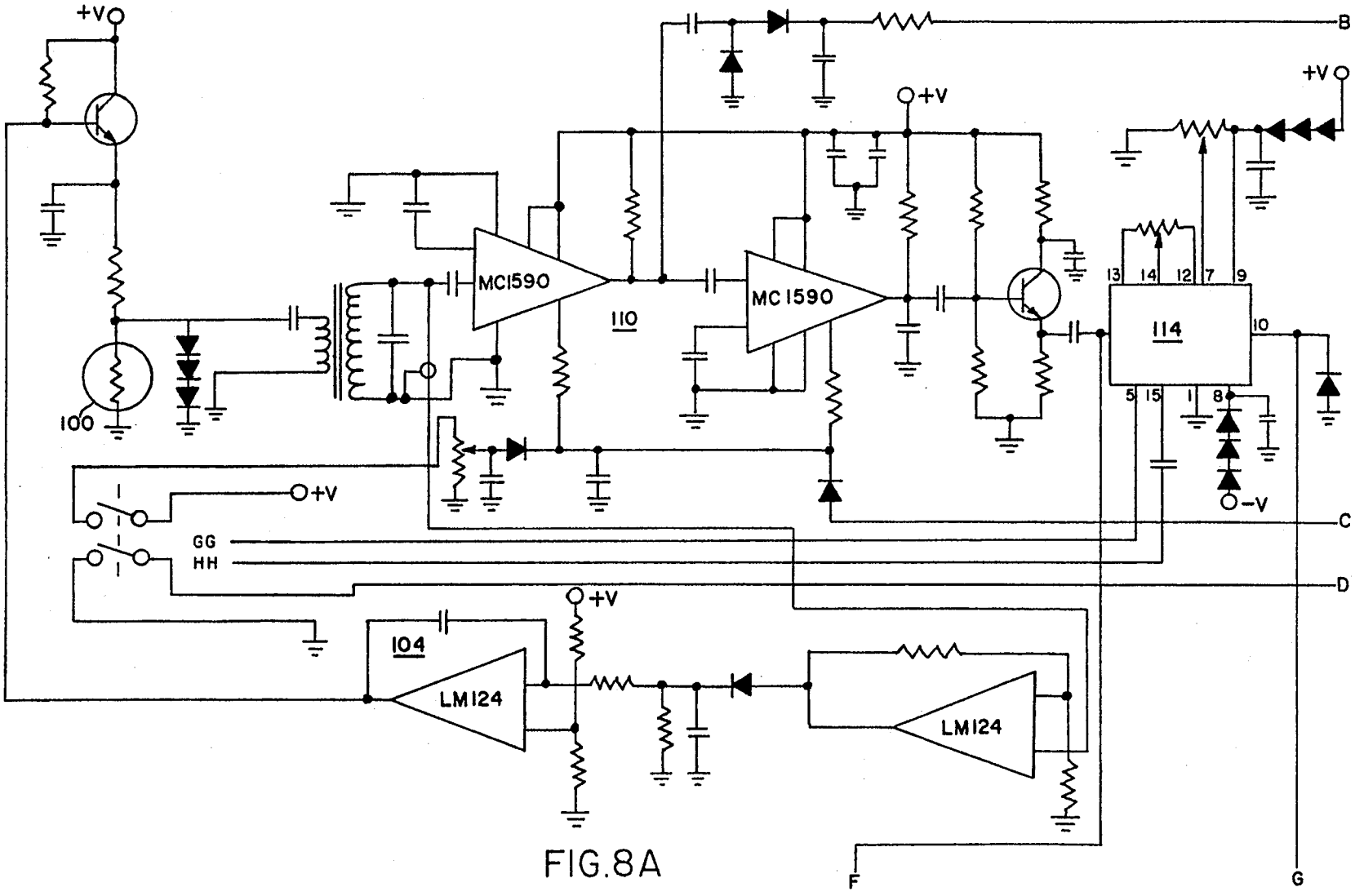
FIGS. 8A–8E are a schematic of the block diagram of FIG. 7.
Figure 8B:
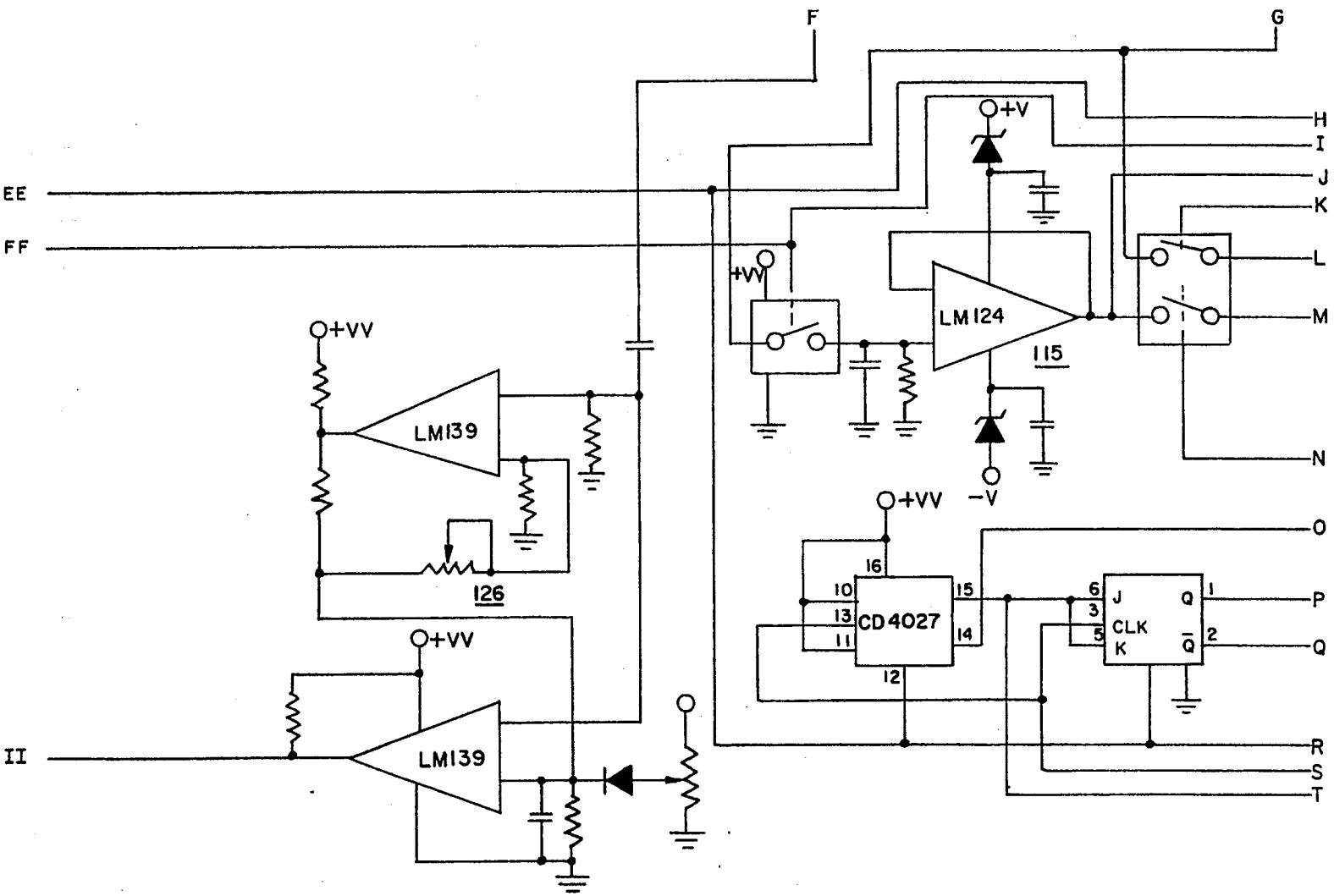
Figure 8C:
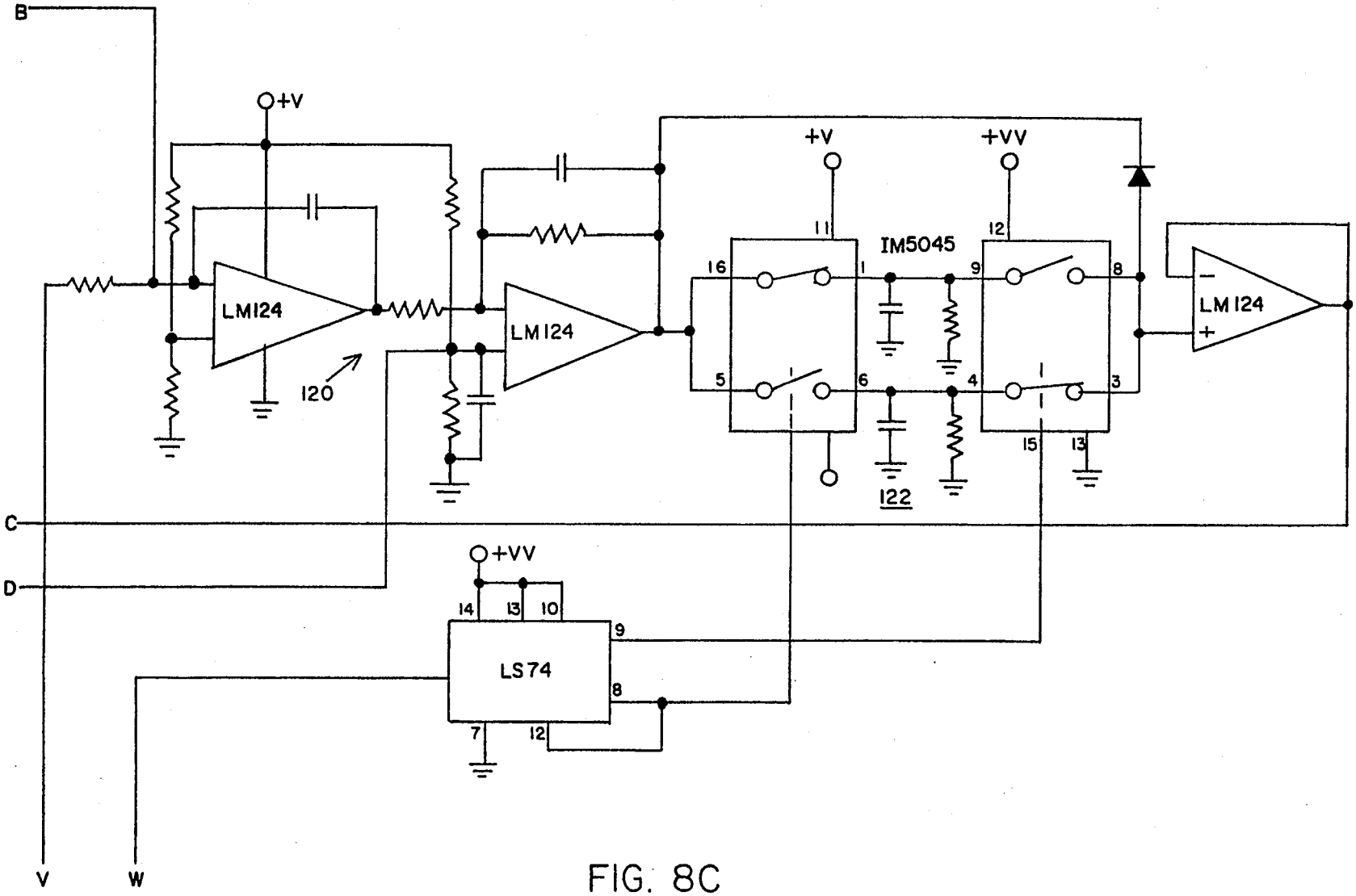
Figure 8D:
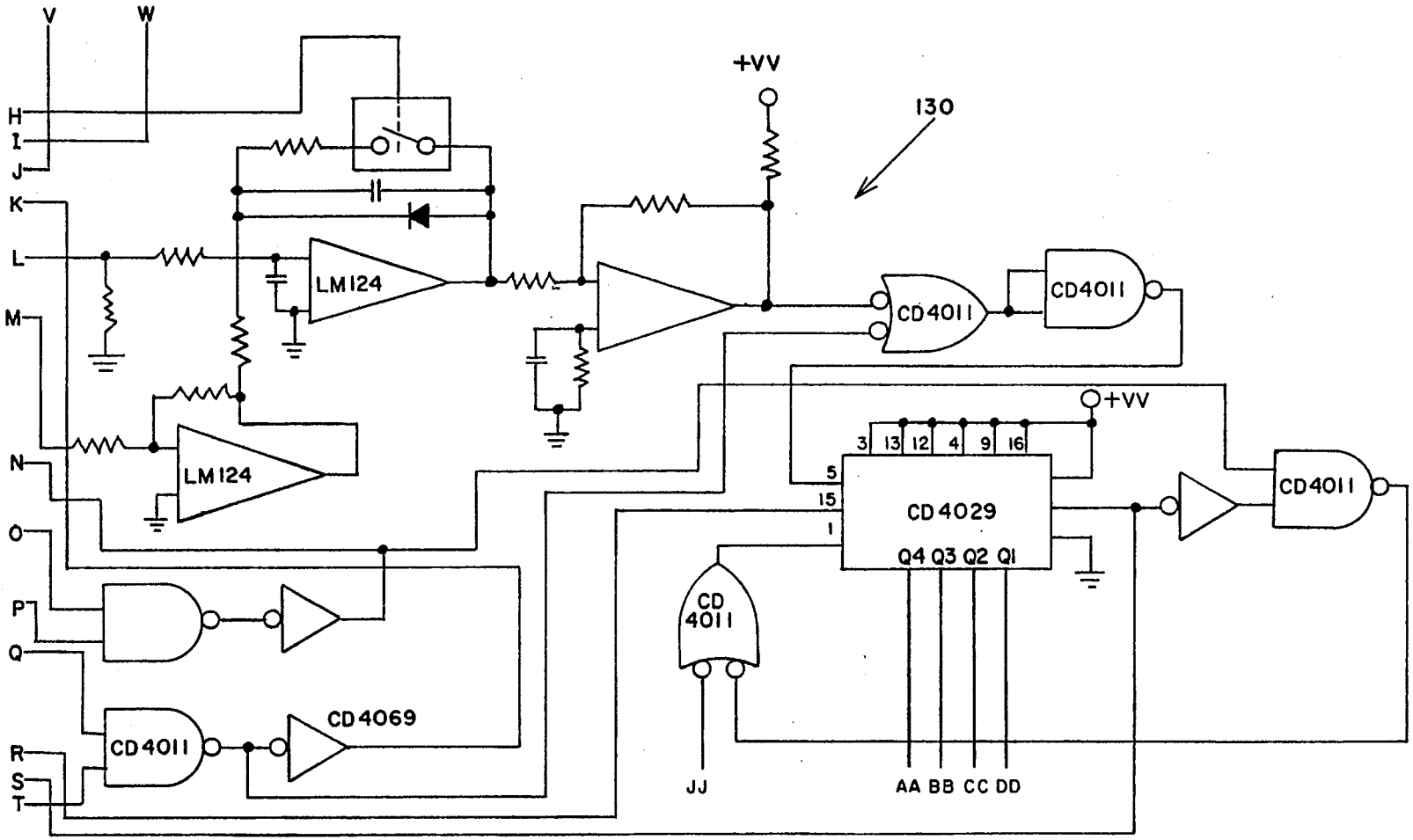
Figure 8E:
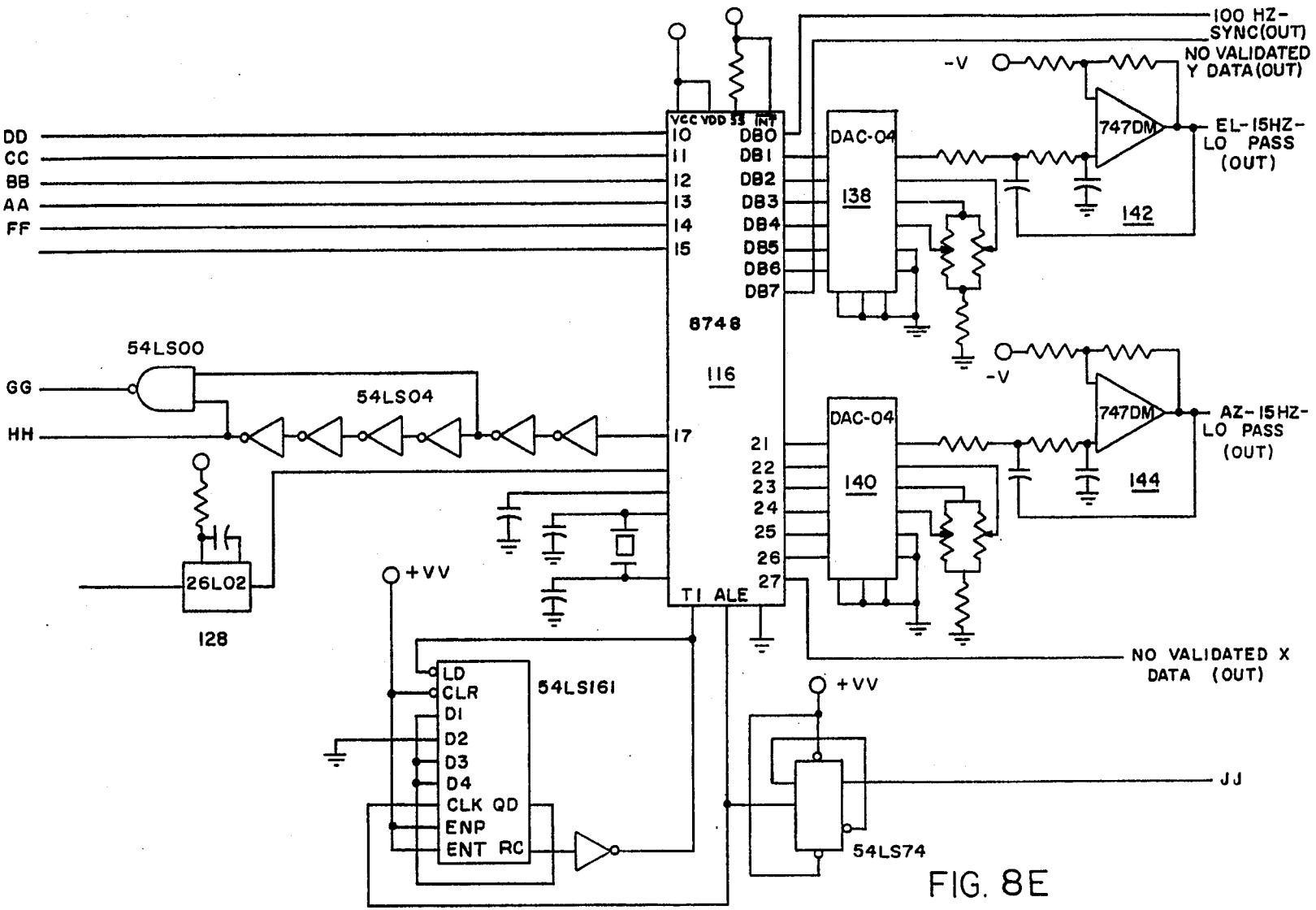

Referring now to FIG. 7 there is illustrated thereby a block diagram of a system for determining the position of the receiver in the beam in accordance with the teaching of this invention. The projected signal is received and applied to an infrared detector 100 which is preferably a photoconductive detector; however, a photovoltaic detector could be used instead. A photoconductive detector is preferred because it can be variably biased, which is helpful since the signal from the projector may vary by three or four orders of magnitude.

The detector 100 has an electrical input 102 thereto which is a bias control for the detector. The signal 102 is derived from an integrator circuit 104 which is preferably a differential amplifier employed as an integrator. The inputs to integrator 104 are an output 106 from the detector 100 and a reference voltage 108 here illustrated as 0.05 volts. When the signal on line 106 from the detector is lower than the reference signal of 0.05 volts, the integrator causes maximum bias voltage on the detector. When the signal on line 106 is greater than 0.05 volts, the bias is reduced proportionally. Therefore over a relatively long time period the average voltage from detector 100 will be 0.05 volts. This circuit will not follow atmospheric scintillation because it is not fast enough.

The output from the IR detector 100 is applied to an amplifier 110 receiving as a second input thereto an AGC (automatic gain control) input 112. It is in this amplifier where the real gain control occurs. This amplifier maintains the gain as a constant for each triplet (reference pulse plus complementary data pulses). The gain of the amplifier 110 is adjusted according to the amplitude of the previous reference pulse.

Pulses from amplifier 110 are gated into a peak and hold circuit 114. This circuit holds the amplitude of every pulse for approximately one pulse interval. This circuit is enabled and reset under control of a microprocessor 116. This loop comes into play only after the receiver is synchronized as described hereinafter.

The output of the peak and hold circuit 114 is applied to a sample and hold circuit 115. Circuit 115 holds the value of each reference pulse only under control of the microprocessor. The output of circuit 115 is compared to a reference voltage 118; for example, 0.4 volts, in an integrator 120, preferably comprising a differential amplifier. The difference between the output of sample and hold circuit 115 and reference voltage 118 is integrated and stored in a sample and hold delay circuit 122. This circuit samples and holds this value for a triplet period. The output of this circuit is the AGC input to amplifier 110. It, thus, supplies to amplifier 110 the value from the previous reference pulse which was stored in the sample and hold circuit. The loop 114 just described is sufficiently fast acting to take out most of the scintillation-induced amplitude variations.

Synchronization of the system occurs by applying the output of amplifier 110 to a CFAR (constant false alarm rate) threshold circuit 126 to set the noise rejecting threshold of the system. This circuit generates a digital signal when a data or reference pulse exceeds the threshold (all of the reference pulses will exceed the threshold but some of the data signals may not). The output of circuit 126 is applied to a one shot-multivibrator 128 which stretches the output of circuit 126 to generate a standard pulse width which is inputted to the microprocessor 116.

When the microprocessor receives the first pulse in, it starts a timer and looks for another pulse at 90% of normal pulse interval. If it does not find it, it resets and starts the timer again on the next pulse. This other pulse is the reference pulse $R_0$. When it receives the reference pulse ($R_0$), it goes into a run mode and, using its internal crystal oscillator and timer, generates various command signals illustrated in the block diagram and also does computation on the data inputs. The data inputs are the ratios $$\frac{X_n}{R_n}.$$

The microprocessor uses these to generate the K values. The computer program for the Intel 8748 microprocessor 116 is set forth hereinafter.

The outputs of the sample and hold circuit 115 are the reference values $R_0$, $R_1$, etc. held during the triplet time. These are applied to a ratiometric analog to digital convertor 130 along with the data signals from the peak and hold circuit 114. This circuit measures the ratio of the two inputs and converts the output to a digital value. If desired, the ratiometric circuit could be eliminated and the microprocessor could be programmed to take the absolute values and convert the ratios.

After each triplet, microprocessor 116 via line 132 resets the circuit 130. The microprocessor has two data outputs. Along line 134 the "X" coordinate of the receiver is outputted and along line 136 the "Y" coordinate is outputted. Each of these signals are applied to respective digital to analog convertors 138 and 140, respectively, to generate error signals which are filtered by filters 142 and 144, respectively. Details of the block diagram of FIG. 7 are illustrated in the schematic of FIGS. 8A–8E. If desired, as for an all-digital control system, the D/A converters may be eliminated and the digital outputs used directly.

The same circuit is employed for the earlier discussed embodiment wherein a shifted knife-edge is used rather than Gray code pattern sequence and the microprocessor programmed accordingly.

Although the invention has been described as useful for encoding space for an optically guided missile, this is only one use therefor since it has other applications. For example, it is useful in curve followers or curve digitizers (apparatus to digitize the points of a curve) to, for example, supply data to a computer. Alternatively, it is useful in plotters where one wishes to draw (follow) a curve stored in a computer.

The pen detects its position using the space encoding techniques described hereinbefore and external circuitry is employed to compare the actual position of the pen to a desired position and then generate an error signal to drive the pen to the desired position. For these types of applications, instead of projecting a beam into space, the reticle patterns would be projected onto a screen of the platte or other similar apparatus where there is a receiver positioned in a two dimensional surface and it is desired to determine its location on the plane.

Note that any means of creating intensity distributions approximating the waveforms E, G and I of FIG. 5 (and successively coarse patterns, if desired) may be used. The use of optical diffraction is not necessary. In fact the more exact the approximation to the linear gradients of these waveforms and the matching of the transitions (i.e. transition point of slope to flat portion of curve E should match transition point of flat to-slope portion of curve G), the finer the interpolation that can be made and the more accurate the position measurement.

The invention is also useful for optical shaft encoders and all other spatial encoding techniques. Furthermore, while the invention has been described in conjunction with the use of optical patterns, other types of energy could be used instead as, for example, electrical, magnetic or acoustic with the use of appropriate transducers. The optical patterns described herein are directly applicable to projection in a millimeter wave optical system, where the $CO_2$ laser would be replaced by a feed horn and the projection lens would be made of other dielectric material. The mathematical form of the projected patterns is the same as described herein. Thus, it is to be understood that the embodiments shown are illustrative only, and that many variations and modifications may be made without departing from the principles of the invention herein disclosed and defined by the appended claims.

I claim:

1. A method for determing the position of a receiver with respect to a beam projector having a lens of predetermined diameter which emits a coded beam of predetermined wavelength which includes a clear reference pattern followed by a first coded pattern which divides the beam into clear and dark areas followed by a complementary coded pattern which divides the beam into dark and clear areas such that the clear areas in the beam from the first coded pattern are dark areas from the complementary coded pattern and vice versa and with the ratio of said wavelength to said lens diameter being sufficiently large such that the lines of demarcation between dark and clear areas of the beam are diffraction limited and provide to a detector receiving the beam a varying amount of radiation determined by where in the area of the beam the detector is located, with a portion of said varying amount of radiation being linear over a portion of the area, comprising the steps of:

detecting the radiation in the beam from the clear reference pattern to provide a first electrical signal;

detecting the radiation in the beam from the first coded pattern to provide a second electrical signal;

detecting the radiation in the beam from the complementary coded pattern to provide a third electrical signal;

subtracting said second electrical signal from said first electrical signal to generate a fourth electrical signal; and dividing said fourth electrical signal by said first electrical signal to thereby provide a value which is determinative of receiver position within an area of the beam bounded by the line of demarcation between the light and dark areas of the projected pattern.

2. Apparatus for determining the position of a receiver with respect to a beam projector having a lens of predetermined diameter which emits a coded beam of predetermined wavelength which includes a clear reference pattern followed by a first coded pattern which divides the beam into clear and dark areas followed by a complementary coded pattern which divides the beam into dark and clear areas such that the clear areas in the beam from the first coded pattern are dark areas from the complementary coded pattern and vice versa and with the ratio of said wavelength to said lens diameter being sufficiently large such that the lines of demarcation between dark and clear areas of the beam are diffraction limited and provide to a detector receiving the beam a varying amount of radiation determined by where in the area of the beam the detector is located, with a portion of said varying amount of radiation being linear over a portion of the area, comprising:

means for detecting the radiation in the beam from the clear reference pattern to provide a first electrical signal;

means for detecting the radiation in the beam from the first coded pattern to provide a second electrical signal;

means for detecting the radiation in the beam from the complementary coded pattern to provide a third electrical signal;

means for subtracting said second electrical signal from said first electrical signal to generate a fourth electrical signal; and means for dividing said fourth electrical signal by said first electrical signal to thereby provide a value which is determinative of receiver position within an area of the beam bounded by the line of demarcation between the light and dark areas of the projected pattern.

3. Apparatus for determining the position of a receiver in a beam, made up of three pairs of complementary data reticle patterns in the form of a Gray code, relative to a predetermined position which is bounded by distributed patterns of energy for generating linear transfer functions, comprising:

means for detecting radiation from said distributed patterns of energy;

means coupled to said detecting means for generating electrical signals; and means coupled to said electrical signal generating means for processing radiation from said distributed patterns of energy to determine fine position of the receiver by interpolating from at least one of said linear transfer functions which lies within a coarse determined area, said processing means including means for taking the difference of the normalized signals from the pairs of complementary reticle patterns to generate the functions $K_0$, $K_1$ and $K_2$, means for generating a Gray code number by thresholding the difference of the normalized signals from the pairs of complementary reticle patterns, and means for processing the Gray code number and the normalized difference signals in accordance with the formulas:

for a value of $G_2=0$ $$Xout=2(\lambda/D)(G_0-0.5)|[1+0.5(|K_0|+K_1+K_2)]|$$

and for a value of $G_2=1$ $$Xout=2(\lambda/D)(G_0-0.5)|[1.75+0.5(|K_0|+K_2)-0.25K_1]|$$

where:

$G_2$=least significant bit of Gray code number,

X=receiver position,

λ=wavelength of beam radiation in any units of measurement,

D-diameter of transmitting aperture in the same units of measurement as λ, $G_0$=most significant bit of Gray code number, and $K_0$=normalized difference signal from the first complementary reticle pattern in the beam, $K_1$=normalized difference signal from the second complementary reticle pattern in the beam, and $K_2$=normalized difference signal from the third complementary reticle pattern in the beam.

4. Apparatus as defined in claim 3, wherein X=⊖, ⊖ being equal to the decimal value of vertical or horizontal angular coordinate in beam.

5. Apparatus as defined in claim 3, wherein X=tan⊖, ⊖ being equal to the decimal value of vertical or horizontal angular coordinate in beam.

6. Apparatus for determining position of a receiver in a beam, made up of complementary data reticle patterns in the form of a Gray code, relative to a predetermined position which is bounded by distributed patterns of energy for generating linear transfer functions, comprising:

means for detecting radiation from said distributed patterns of energy:

means coupled to said detecting means for generating electrical signals; and means coupled to said electrical signal generating means for processing radiation from said distributed patterns of energy to determine fine position of the receiver by interpolating from at least one of said linear transfer functions which lies within a coarse determined area, said processing means including means for taking the difference of the normalized signals from the complementary reticle patterns to generate the functions K; means for generating a Gray code number by thresholding the difference of the normalized signals from the complementary reticle patterns, and means for processing the Gray code number and the normalized difference signals in accordance with the formulas:

$$X = 2(G_0 - 1/2)(\lambda/D)\left[1/2 + \sum_{n=1}^{N} B_n 2^{n-1} + 1/2 \sum_{n-0}^{N} A_n K_n\right]$$

where:

X=receiver position, $G_0$=Gray code sign bit,

λ=wavelength of radiation in any units of measurement,

D=diameter of transmitting aperture in the same units of measurement as λ,

N=number of Gray code reticle pairs projected per axis or number of bits in received code words, $B_n$=value of nth binary bit (after Gray code word is converted to natural binary), $K_n$=normalized difference in amplitude of nth Gray code pulse pair, and $A_n$=slope coefficient, the $A_n$ term being defined as follows:

after conversion of the N bit Gray code number to natural binary, but using the definitions:

$B_0$=sign bit, $B_{N-1}$=most significant bit, $B_1$=least significant bit, and $B_N=0$ $$|A_0|=\overline{B_{N-1}+B_{N-2}+\ldots B_1}$$

$$|A_1|=1$$

$$|A_2|=B_2\oplus B_1), \text{ where } \ominus \text{ is exclusive OR operation}$$

$$|A_n|=(B_n\oplus B_{n-1}).(\overline{B_{n-1}\oplus B_{n-2}}).(\overline{B_{n-2}\oplus B_{n-3}}).\ldots.(\overline{B_2\oplus B_1})$$

the signs of the slope coefficients being obtained from the following rules:

1. Sign of $A_0$ is + always
2. Sign of $A_n$ is + when $B_{n+1}=0$.

7. Apparatus as defined in claim 6, wherein X=⊖, ⊖ being equal to the decimal value of vertical or horizontal angular coordinate in beam.

8. Apparatus as defined in claim 6, where X=tan⊖, ⊖ being equal to the decimal value of vertical or horizontal angular coordinate in beam.

9. A method of determining the position of a receiver relative to a beam projector which emits a beam including three pairs of complementary Gray code reticle patterns and at least one reference pattern, comprising the steps of:

measuring the signals received from the beam;

generating a Gray code number from the measured signals;

determining from the Gray code number the coarse position of the receiver; and utilizing the measured signals and Gray code number to determine fine position within the beam in accordance with the formulas:

for a value of $G_2=0$ $$Xout=2(\lambda/D)(G_0-0.5)|[1+0.5(|K_0|+K_1+K_2)]|$$

and for a value of $G_2=1$ $$Xout=2(\lambda/D)(G_0-0.5)|[1.75+0.5(|K_0|+K_2)-0.25K_1]|$$

where:

$G_2$=least significant bit of Gray code number,

X=receiver position,

λ=wavelength of beam radiation in any units of measurement,

D=diameter of transmitting aperture in same units of measurement as λ, $G_0$=most significant bit of Gray code number, and $K_0$=normalized difference signal from the first complementary reticle pattern in the beam, $K_1$=normalized difference signal from the second complementary reticle pattern in the beam, and $K_2$=normalized difference signal from the third complementary reticle pattern in the beam.

10. Apparatus as defined in claim 9, wherein $X=\ominus$, $\ominus$ being equal to the decimal value of vertical or horizontal angular coordinate in beam.

11. A method of determining the position of a receiver relative to a beam projector which emits a beam including complementary Gray code reticle patterns, comprising the steps of:

measuring the signals received from the beam;

generating a Gray code number from the measured signals;

determining from the Gray code number the coarse position of the receivers; and utilizing the measured signals and Gray code number to determine fine position within the beam in accordance with the formulas:

$$X = 2(G_0 - 1/2)(\lambda/D)\left[1/2 + \sum_{n=1}^{N} B_n 2^{n-1} + 1/2 \sum_{n=0}^{N} A_n K_n\right]$$

where:

X-receiver position $G_0$=Gray code sign bit, $\lambda$=wavelength of radiation in any units of measurement, D=diameter of transmitting aperture in the same units of measurement as $\lambda$, N=number of Gray code reticle pairs projected per axis or number of bits in received code word, $B_n$=value of nth binary bit (after Gray code word is converted to natural binary), $K_n$=normalized difference in value of nth Gray code pulse pair, and $A_n$=slope coefficient, the $A_n$ term being defined as follows:

after conversion of the N bit Gray code number to natural binary, but using the definitions:

$B_0$=sign bit, $B_{N-1}$=most significant bit, $B_1$=least significant bit, and $B_n$=0, $$|A_0| = B_{N-1} + B_{N-2} + \ldots B_1$$

$$|A_1| = 1$$

$$|A_2| = (B_2 \oplus B_1), \text{ where } \ominus \text{ is exclusive OR operation}$$

$$|A_n| = (B_n \oplus B_{n-1}).(B_{n-1} \oplus B_{n-2}).(B_{n-2} \oplus B_{n-3}). \cdots (B_2 \oplus B_1)$$

the signs of the slope coefficients being obtained from the following rules:

1. Sign of $A_0$ is + always
2. Sign of $A_n$ is + when $B_{N+1}=0$.

* * * * *